US006669657B1

(12) United States Patent
Ongwela

(10) Patent No.: US 6,669,657 B1
(45) Date of Patent: Dec. 30, 2003

(54) MASSAGE AND TACTILE STIMULATION DEVICE

(76) Inventor: Deanna Thurman Ongwela, 9231 Redbridge Ct., Laurel, MD (US) 20723

( * ) Notice: Subject to any disclaimer, the term of this patent is extended or adjusted under 35 U.S.C. 154(b) by 4 days.

(21) Appl. No.: 09/665,608

(22) Filed: Sep. 20, 2000

(51) Int. Cl.[7] ..... A61H 7/00
(52) U.S. Cl. ..... 601/134; 601/135
(58) Field of Search ..... 601/134, 135, 601/136–138

(56) References Cited

U.S. PATENT DOCUMENTS

| | | | | |
|---|---|---|---|---|
| 1,161,719 A | | 11/1915 | Norton | |
| 1,438,485 A | | 12/1922 | Goldberg | |
| 1,885,572 A | * | 1/1932 | Wood | 601/137 |
| 2,298,959 A | * | 10/1942 | McClurken | 2/169 |
| 2,434,044 A | * | 1/1948 | Levine | 2/169 |
| 3,749,064 A | * | 7/1973 | Weinstein et al. | 119/664 |
| 4,168,545 A | * | 9/1979 | Kupperman et al. | 2/169 |
| 4,173,216 A | * | 11/1979 | Nolet | 4/583 |
| 4,249,521 A | | 2/1981 | Gueret | |
| 4,577,625 A | * | 3/1986 | Lohati et al. | 128/57 |
| 4,593,427 A | | 6/1986 | Ortolivo | |
| 4,766,914 A | * | 8/1988 | Briggs | 132/212 |
| 5,500,956 A | * | 3/1996 | Schulkin et al. | 2/161.1 |
| 5,524,575 A | | 6/1996 | Lennon | |
| 5,682,837 A | | 11/1997 | Courtney et al. | |
| 5,765,252 A | * | 6/1998 | Carr | 15/104.94 |
| 5,768,709 A | | 6/1998 | Newkirk et al. | |
| 5,848,981 A | * | 12/1998 | Herbranson | 601/134 |

FOREIGN PATENT DOCUMENTS

| | | | | |
|---|---|---|---|---|
| CH | 618857 | * | 8/1980 | |
| DE | 298 02 342 U1 | * | 6/1998 | A61H/7/00 |
| JP | 11-253515 A | * | 3/1998 | A61H/15/00 |
| JP | 11-114010 | * | 4/1999 | |
| JP | 11-114010 A | * | 4/1999 | A61H/37/00 |

* cited by examiner

*Primary Examiner*—Justine R. Yu

(57) ABSTRACT

A massage and tactile stimulation device in the nature of a hand covering such as a mitt, mitten, or glove (10, 20)) to be worn on the hand of a masseur, therapist, or user (recipient) preferably in the embodiment of a glove (10). The device having one or more predetermined prominent projections (12, 18, 22, 24) with or without friction areas (14, 16). Both projections (12, 18, 22, 24) and friction areas (14, 16) may be of various shapes, sizes, colors, forms, and textures including smooth or pimpled. Both projections (12, 18, 22, 24) and friction areas (14, 14') are secured to effective working areas of glove (10, 20) to impart to a subject or patient a variety of distinct and improved manipulations such as deep pressure, grasping, and frictional rubbing.

6 Claims, 1 Drawing Sheet

MASSAGE AND TACTILE STIMULATION DEVICE

BACKGROUND

1. Field of Invention

This invention relates to a new and improved massage and tactile stimulation device having predetermined prominent projections with or without friction areas, for manual control and operation.

2. Description of Prior Art

Manual massage and tactile stimulation have been performed by the hand for centuries. Hand held objects or paraphernalia for massage and tactile stimulation, manual or electric, have been invented to assist with the task.

Massage gloves having a receptacle or receptacles adapted to accommodate a substance or substances during the massage have been invented as shown in U.S. Pat. No. 1,161,719 to Norton. However, these gloves do not address massage to deeper tissues.

Thereafter, U.S. Pat. No. 1,885,572 to Wood shows a massage glove with transverse ribs or ridges on the finger tips and a series or multiplicity of massaging elements or vacuum cups in the palm of the hand. The massaging elements and vacuum cups effect a combined friction and traction upon the patient's body. This glove relies heavily upon the palm for effective execution. As well, it does not address massage to deeper tissues due to lack of massaging elements prominence.

A massage device utilized for lather formation and softening a man's beard is shown in U.S. Pat. No. 1,438,485 to Goldberg. It can also be utilized to receive and retain soap. This device massages the cutaneous covering, at best, not addressing the deeper tissues or advanced manipulations.

Animal gloves for massage and grooming with a plurality of bristles on the palm or palm and fingers are described in U.S. Pat. No. 5,768,709 to Newkirk et al. and U.S. Pat. No. 5,682,837 to Courtney et al. An animal grooming glove with a plurality of rubber projections having an internal portion including a substantially rigid material is shown in U.S. Pat. No. 5,524,575 to Lennon. These devices, though suitable for animals, are not suitable for human massage.

A scalp massaging implement for the finger with a rubber fingertip covering and a plurality of flexible rubber tines is illustrated in U.S. Pat. No. 4,308,860 to Sanders et al. A finger or hand mounted brush with bristles or plurality of bumps or a combination is shown in U.S. Pat. No. 5,765,252 to Carr for effective cleaning and massage. An implement for massaging the cutaneous covering is illustrated in U.S. Pat. No. 4,249,521 to Gueret. While sports gloves having a plurality of friction elements for enhancing the grip, control, and improving skills have been invented including the basketball glove in U.S. Pat. No. 5,500,956 to Schulkin et al. The projections of these inventions lack the prominence and shape necessary for massage to deeper tissues and are suitable for the cutaneous covering, at best.

Hand apparel with cleaning instrumentalites are shown in U.S. Pat. No. 3,643,386 to Grzyll, U.S. Pat. No. 5,441,355 to Moore, U.S. Pat. No. 4,593,427 to Ortolivo, and U.S. Pat. No. 5,419,014 to Piantedosi. There is no disclosure of these gloves as a massaging device for humans.

Massage footwear having foot stimulating, dome-shaped, spaced massage bumps and nonspecific rounded projections with areas that are lightly stippled to prevent slippage is illustrated in U.S. Pat. No. 4,694,831 to Seltzer. However, this is utilized in footwear or as a sole insert having defined accupressure bumps. These bumps are arranged to affect at least 12 key meridians of body function. There is no disclosure for use as a hand covering or versatility of location for use on other areas of the body.

The aforementioned inventions do not address the need for deep pressure, concentrated point specific pressure, vigorous rubbing on the skin, or handling of the muscles to relieve muscle spasms, trigger points, or the like during massage. The masseur must utilize a considerable amount of muscle energy, along with force and pressure on their joints for the benefits of massage to be realized on some recipients.

OBJECTS AND ADVANTAGES

Among the objects of this invention is to provide a new and improved massage and tactile stimulation device in the nature of a hand covering such as a mitt, mitten, or glove worn upon the hand of the user, masseur, or therapist. More specifically, a glove having prominent projections of at least 0.14 inches (3.5 mm) in height, to facilitate deep and point specific pressure on the recipient, being with or without friction areas. These instrumentalities, secured at effective working areas on the device, provide for distinct and improved manipulations over the human hand.

The advantages of this invention as here outlined are best realized when all of its features and instrumentalities are combined in one and the same structure, but, useful devices may be produced embodying less than the whole.

Advantages include but are not restricted to:

a) improved force and concentrated pressure on recipient due to prominence of projections;

b) decreased direct force needed on joint's of manipulator's body to deliver improved manipulations to recipient;

c) will stimulate deep pressure receptors in skin of desensitized limbs or parts of the body;

d) enhances the tactile stimulation or massage of a layperson to a recipient without formal education of manual techniques.

Additional objects, advantages, and novel features of the invention will be set forth in part in the description which follows of the preferred embodiment, pointed out in the subjoined claims, and illustrated on the annexed drawing, wherein like parts are designated by the same reference throughout. Others will become apparent to those skilled in the art upon examination of this description or may be learned by practice of the invention.

REFERENCE CHARACTERS IN DRAWINGS

| | | | |
|---|---|---|---|
| 2 | cross-section through fifth digit | 18 | cone shaped projection |
| 10 | glove of preferred embodiment | 19 | indentation |
| 12 | hemispherical projection on pad of digit(s) | 20 | back view of second embodiment in fist |
| 14 | elliptical friction area | 22 | elongated projection |
| 16 | circular friction area | 24 | canal shaped projection |
| F | surface of recipient | | |

SUMMARY

This invention provides a massage and tactile stimulation device, comprising a flexible glove, having predetermined prominent projections with or without friction areas. Both instrumentalities may be of various shapes, predetermined sizes, colors, textures, and forms secured to the glove at effective working areas, in varied or distinct patterns.

DESCRIPTION

Figure 1:
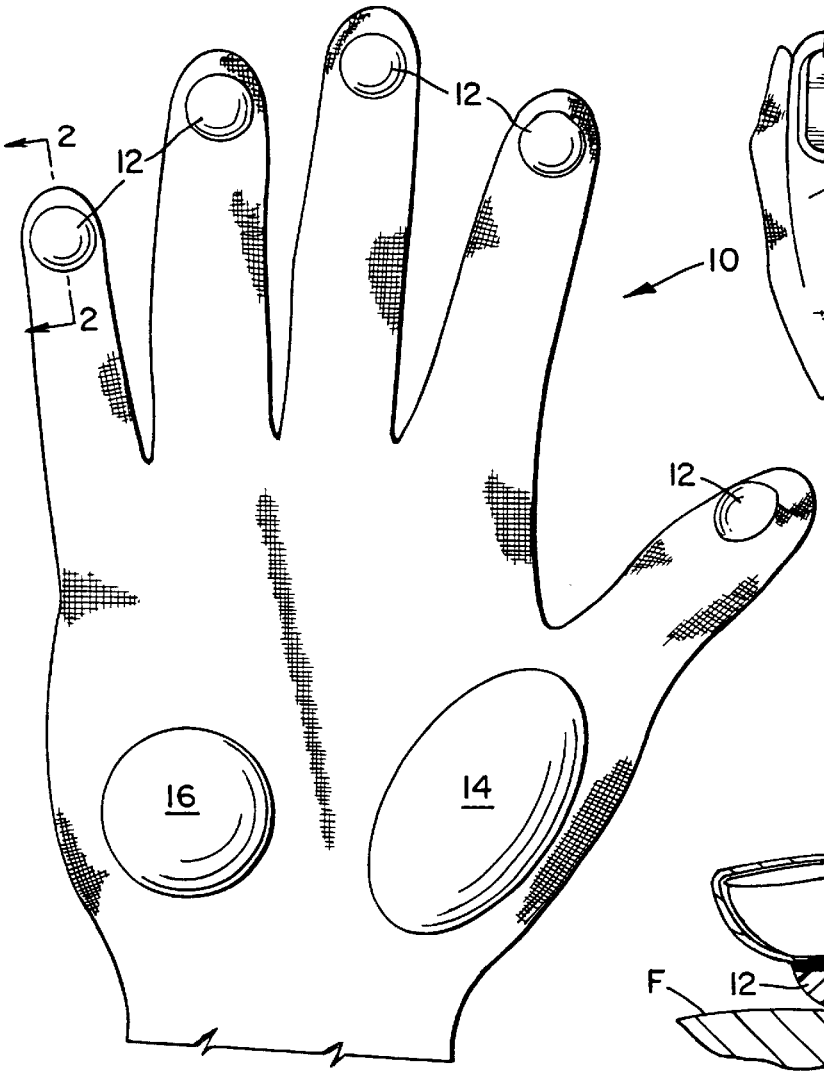
FIG. 1 shows the right palm view of the preferred embodiment of the glove.

It will be obvious to those skilled in the art to which this invention appertains, that the same may be incorporated in several different constructions. It will be understood this device may be made in various sizes and different specific designs. It must be clearly understood that although each finger of the glove in FIG. 1 is provided with a predetermined prominent projection for deep pressure, only one of the fingers may be provided with a projection. If desired, only a single finger tip can be used for applying deep pressure.

Therefore, the accompanying drawing is submitted merely as showing the preferred embodiment of this device. Application can be made to either hand of the manipulator. The illustration is that of a right hand appliance.

Referring now more particularly to the drawing, illustrated is a device as comprising a glove 10 (FIG. 1). Glove 10 is made of any suitable resilient material of good quality such as lycra or spandex that will closely adhere to the anatomy of the hand. Glove 10 is made by sewing or the like, in the preferred embodiment.

Figure 2:
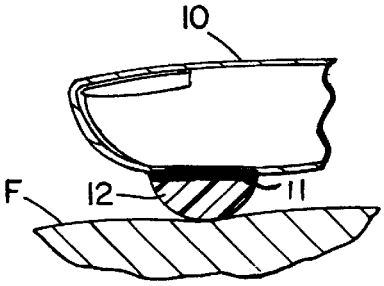
FIG. 2 shows a cross-sectional view taken along line 2—2 of FIG. 1 illustrating use of a hemispherical projection.
Figure 4:
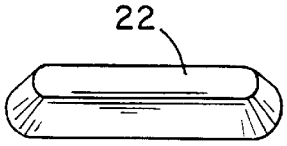
FIG. 4 shows an elongated projection.

In the preferred embodiment, glove 10 has a predetermined prominent (FIG. 2) projection 12, illustrate as hemispherical. In a second embodiment, glove 20 (FIG. 6) has predetermined prominent projection 22 (FIGS. 4 and 6),illustrated as an elongated projection.

Figure 6:
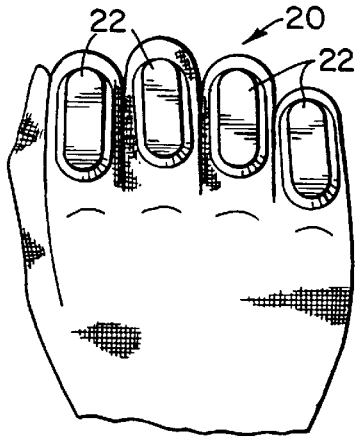
FIG. 6 shows a second embodiment formed as a fist with the projection of FIG. 4 in place.

Projections 12 and 22 adhere to glove 10 and 20 by virtue of pressure sensitive adhesion or other method for bonding plastic to cloth, that provides stationary bonding. Projection 12 is secured to glove 10 at a first effective working area to optimize use. Projection 12 is located on the pad of each digit. Projection 22 is secured to glove 20 at a second effective working area. Projection 22 is located on the back of the first row of phalanges (proximal) to impart considerable force and pressure to the recipient when glove 20 is held in a clenched fist (FIG. 6).

Projections 12 and 22 are applied to the surface of recipient F (FIG. 2) with a stationary pressure or varied by a deep circular motion or frictional rubbing, either by full arm movement or merely the pressure of the digit(s). These techniques stimulate the sensory nerve endings for deep pressure, increase blood flow to area, and relieve muscle tension.

The preferred embodiment includes friction areas 14 and 16 secured to glove 10 at effective working areas third and fourth, respectively. Area 14 is elliptical in shape covering the palm pad of the thumb (thenar). Area 16 is circular in shape covering the pisiform bone located at base of the fifth digit pad (hypothenar). Adhered to glove 10 by the same method as projections 12 and 22, areas 14 and 16 are made of a rubber-like material with a sufficient coefficient of friction to facilitate improved manual manipulations such as grasping and frictional rubbing. Areas 14 and 16 are secured to glove 10 at effective working areas such as the palm region, between the thumb and index finger (not shown), and lateral fifth digit region (not shown). Areas 14 and 16 enhance manual manipulations over the human hand.

Figure 3:
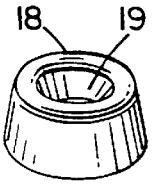
FIG. 3 shows an indented cone shape projection.
Figure 5:
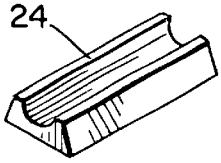
FIG. 5 shows a canal shaped projection.

It will be understood that the device may be made in various sizes, varied or different specific designs, and for application to either hand of the manipulator. It is self evident with the device as illustrated, the projections (FIGS. 2, 3, 4 and 5) and friction areas (FIG. 1) can be of various shapes, predetermined sizes, colors, forms, and textures. Examples of additional shapes include cone shaped projection 18 with an indentation 19 (FIG. 3) and canal shaped projection 24 (FIG. 5). They can be varied on the same glove, as well. Both can be secured to the glove at various effective working areas to maximize function of device and assistance to the manipulator.

The material for making this device can be of any with stretching capabilities, but grossly maintains its shape. This device can be made as any type of hand covering. An alternative to a hand covering is a covering for the elbow or foot (both not shown), as these areas are used for imparting massage, as well. However, use on the hand is the preferred embodiment.

Furthermore, various changes and modifications may be made to the embodiments described without departing from the scope of the present invention defined in the appended claims.

Conclusion, Ramifications, and Scope of Invention

Thus the reader will see that the massage and stimulation device of this invention provides the manipulator with enhanced massage techniques and ease of use. In addition, it imparts to the recipient a multiplicity of improved manipulations due to the prominent projections of at least 0.14 inches (3.5 mm) in height and friction areas.

The above description should not be construed as limitations on the scope of this invention, but rather as an exemplification of a preferred embodiment thereof. Many other variations are possible. For example, the glove can have a prominent projection of any predetermined size and shape on one digit only, such as the pad of the thumb. This device can appear as a functional hand covering that is used as a pouch with a prominent projection having the diameter of the central palm region. If desired, the glove can be manufactured without friction areas. The glove material can be textured for additional sensory input, particularly for desensitized limbs or areas of the body.

An improvement can include a rubber-like glove with a breathing mechanism, to decrease moisture on the hand, made by molding or the like. The glove and its instrumentalities, can be made of a rubber-like material that can be easily disposed of or cleaned for sanitary use in a healthcare setting, increasing its use in settings with multiple clients.

Thus the scope of the invention should be determined not by the embodiment illustrated, but by the appended claims and their legal equivalents.

I claim:

1. A massage and tactile stimulation device comprising a glove made of a resilient material having a front wall and a back wall connected by a means for joining two pieces of material to form fingers, a palm area and a backhand area, said glove having a first effective working area on the front wall of said fingers having stationary upward hemispherical projections, a second effective working area located on the back wall of said fingers having stationary elongated projections with flat upward surface, and a third effective working area located on said palm area having friction areas secured to said glove elliptical in shape covering the palm pad of the thumb and circular in shape covering the pisiform bone located at base of the fifth digit pad, said glove having one or more upward projections of at least 0.14 inches (3.5 mm) in height secured at both said first and second effective working areas of the glove, said upward projections and said friction areas being attached to said glove by a stationary bonding means wherein no part of the one or more upward projections and the one or more friction areas move with respect to said glove walls.

2. The glove of claim 1 wherein said resilient material is lycra.

3. The glove of claim 1 wherein said means for joining two pieces of material is sewing.

4. The glove of claim 1 wherein said first and second effective working areas each having said upward projections and third effective working area having said friction areas secured thereto, are exclusively located at pad of digits, phalanges region and a palm, respectively.

5. The glove of claim 4 wherein said upward projections are single, individual protrusions located on each said pad of digits and said phalanges region, whereby deep pressure is imparted by said device, and whereby said projections optimize the benefits of massage and tactile stimulation.

6. The glove of claim 1 wherein said stationary bonding for said upward projections and said friction area is pressure sensitive adhesion.

* * * * *